US005417419A

United States Patent [19]

Anderson et al.

[11] Patent Number: 5,417,419

[45] Date of Patent: May 23, 1995

[54] GOLF CLUB WITH RECESSED, NON-METALLIC OUTER FACE PLATE

[76] Inventors: Donald A. Anderson, 7861 Clay Ave. #4, Huntington Beach, Calif. 92648; Donald J. C. Sun, 4521 Ocean Valley La., San Deigo, Calif. 92130

[21] Appl. No.: 136,602

[22] Filed: Oct. 14, 1993

Related U.S. Application Data

[63] Continuation of Ser. No. 714,181, Jun. 14, 1991, abandoned, which is a continuation-in-part of Ser. No. 492,973, Mar. 13, 1990, Pat. No. 5,024,437, which is a continuation-in-part of Ser. No. 364,698, Jun. 12, 1989, abandoned.

[51] Int. Cl.[6] ..... A63B 53/04; B23K 31/00

[52] U.S. Cl. ..... 273/78; 273/173; 273/167 H; 228/162; 228/125; 29/527.6; 29/428

[58] Field of Search ..... 273/167 R–77 A, 273/77 R, 78, DIG. 23, DIG. 8; 29/527.5, 527.6, 428, 445, 451; 228/182, 176, 162, 125

[56] References Cited

U.S. PATENT DOCUMENTS

| | | | |
|---|---|---|---|
| 3,695,618 | 10/1972 | Woolley et al. | 273/78 X |
| 3,975,023 | 8/1976 | Inamori | 273/173 |
| 4,021,047 | 5/1977 | Mader | 273/167 H |
| 4,398,965 | 8/1983 | Campau | 273/78 X |
| 4,429,879 | 2/1984 | Schmidt | 273/167 H |
| 4,438,931 | 3/1984 | Motomiya | 273/167 H |
| 5,024,437 | 6/1991 | Anderson | 273/173 X |

FOREIGN PATENT DOCUMENTS

| | | | |
|---|---|---|---|
| 211781 | 12/1957 | Australia | 273/167 J |
| 2191475 | 7/1990 | Japan | 273/167 H |
| 243435 | 11/1925 | United Kingdom | 273/173 |
| 1227948 | 4/1971 | United Kingdom | 273/173 |
| 2173407 | 10/1986 | United Kingdom | 273/173 |

OTHER PUBLICATIONS

"Golf Digest" Magazine, Jan. 1975 issue, pp. 40 and 41.

*Primary Examiner*—Sebastiano Passaniti

*Attorney, Agent, or Firm*—Page Lohr Associates

[57] ABSTRACT

A golf club head that comprises a main body portion formed by an investment casting of a first metallic material, and forming a cavity; a face reinforcement plate formed of metallic material, only the periphery of the face reinforcement plate is integral with the main body portion to support the plate, the plate forming a recess bounded by a peripheral lip; and a non-metallic ball striking second plate received in a recess and retained therein.

10 Claims, 7 Drawing Sheets

GOLF CLUB WITH RECESSED, NON-METALLIC OUTER FACE PLATE

BACKGROUND OF THE INVENTION

This is a continuation of application Ser. No. 07/714,181, filed on Jun. 14, 1991, which was abandoned upon the filing hereof which was continuation-in-part of Application Ser. No. 07,492,973, filed Mar. 13, 1990, issued on Jun. 18, 1991, as U.S. Pat. No. 5,024,437, which was a continuation-in-part application Ser. No. 07/364,698, filed Jun. 12, 1989, now abandoned.

This invention relates to golf clubs and more particularly to an improved face plate construction for a metal wood configuration golf club head.

Golf clubs have been formed as a one-piece casting of durable materials, such as stainless steel, and other metals. A head of this type is described in U.S. Pat. No. 4,021,047 issued May 3, 1977 to R. J. Mader. Face plates made of a different material than that of the main body of the club head have been used in both irons and "wood"-type heads. Examples are enclosed in U.S. Pat. No. 4,792,140, issued Dec. 20, 1988, to Yamaguchi et al.; U.S. Pat. No. 4,534,558 issued Aug. 13, 1985, to Yoneyama; U.S. Pat. No. 3,218,072, issued Nov. 16, 1965, to Burr; and British Patent No. 1,227,948 issued Apr. 15, 1971, to Haines et al. In the heads of these prior art patents, no way was known to provide a non-metallic face plate in a hollow, thin walled, metal head of wood type configuration, in the simple effective manner as now afforded by the present invention.

SUMMARY OF THE INVENTION

The golf club head of the present invention provides an improvement over prior art heads in that it utilizes a face plate of non-metallic material which is supported by a thin reinforcement plate interposed between the face plate and the head hollow or cavity. This result is achieved without greatly increasing the cost or weight of the wood type head by forming the main body of the head and the reinforcement plate as an investment casting of a material such as stainless steel, beryllium copper, titanium, or aluminum, and then attaching the non-metallic face plate to the reinforcement plate, in a recess formed by the latter.

The thin non-metallic face plate, when reinforced as disclosed herein, slightly compresses when impacted by the ball, and restores as the ball leaves that face plate as aided by flat spring action of the reinforcing metal plate, to enhance ball and driving control; also the sound of face plate impact with the ball is favorable and desirable.

Accordingly, the invention is embodied in a golf club head that includes:

a) a main body portion formed by an investment casting of a first metallic material, and forming a cavity, b) a front face reinforcement plate formed of metallic material, only the periphery of the face reinforcement plate being integral with the main body portion to support the plate, the plate forming a recess bounded by a peripheral lip, c) and a non-metallic ball striking second plate received in that recess and retained therein.

As will appear, the main body portion of the head and the reinforcement plate may consist essentially of a cast metal selected from the group consisting of steel, beryllium copper, and aluminum; and the second, i.e. outer face plate typically consists of a material selected from the group consisting of graphite, ceramic, and KEVLAR. The second plate is preferably bonded to the reinforcement plate and compressed to peripherally pressurally engage the lip bounding the recess, graphite being a preferred material for this purpose.

Further, the second plate typically has generally trapezoidal forward facing configuration with top and bottom elongated, shallowly curved extents, the top curved extent being upwardly convex, and the bottom curved extent being downwardly convex; and it may have sideward extents respectively convex toward the club head toe and heel.

The method of forming the metallic golf club head, of wood configuration, includes the steps a) providing a golf club head main body consisting of metal, and a metallic front face reinforcement plate peripherally connected to said main body which is hollow, b) said reinforcement plate forming a recess bounded by a lip, c) providing a non-metallic ball striking second plate, and affixing the second plate to the reinforcement plate, so as to be inset in that recess and bounded by said lip.

Another object is to provide a method as referred to which includes the step of grinding the lip and said second plate to form a forwardly facing smooth ball striking head surface wherein the forward face of the non-metallic second plate is flush with the forward facing surface of the peripheral metallic lip. Such grinding is typically carried out to reduce the thickness of the graphite plate to a thickness of about 2 mm, and the metallic reinforcement plate also having about the same thickness, so as to flex slightly, as the graphite plate is compressed, during ball impact. This combination of compression and flexing aids in providing favorable ball striking and control, during the swing of the club.

A further object is to provide a forged metal plate carrying the graphite plate, and welded to a cast head main body portion, to enhance strength and weight re-distribution.

These and other objects and advantages of the invention, as well as the details of an illustrative embodiment, will be more fully understood from the following specification and drawings, in which.

DETAILED DESCRIPTION OF THE DRAWINGS

Figure 1:
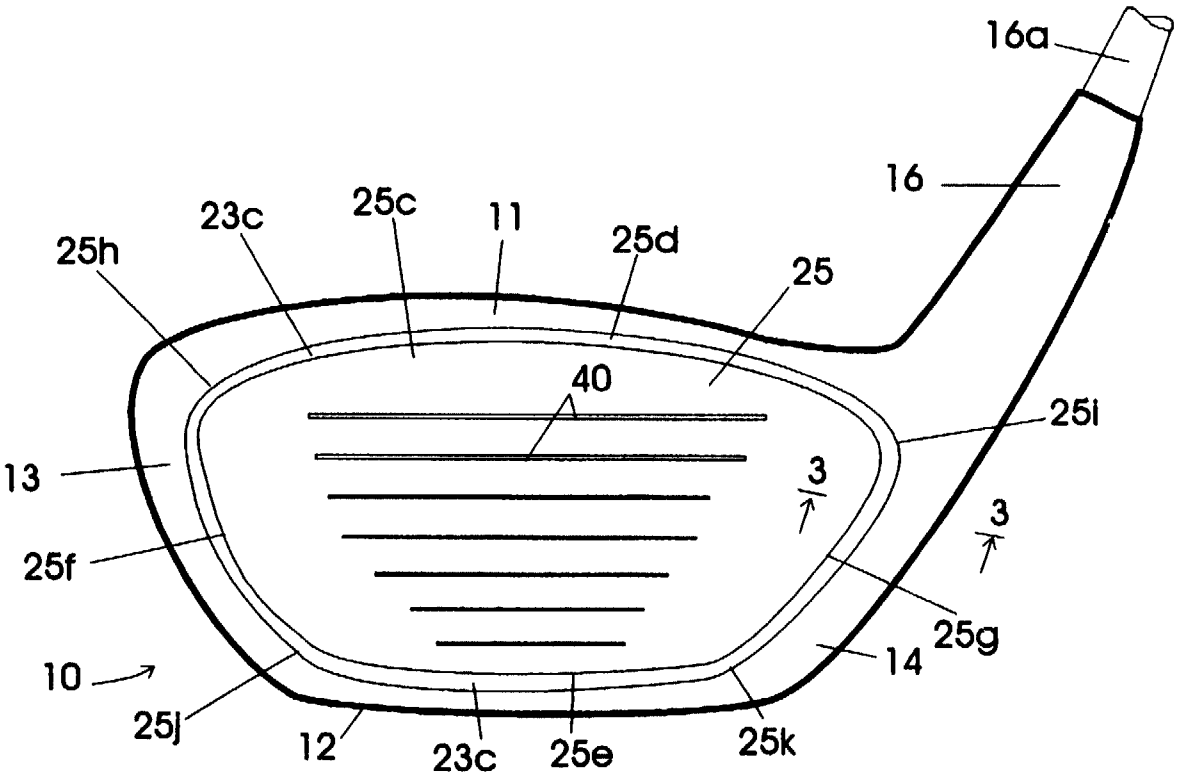
FIG. 1 is a front elevational view of a club head embodying the invention.
Figure 2:
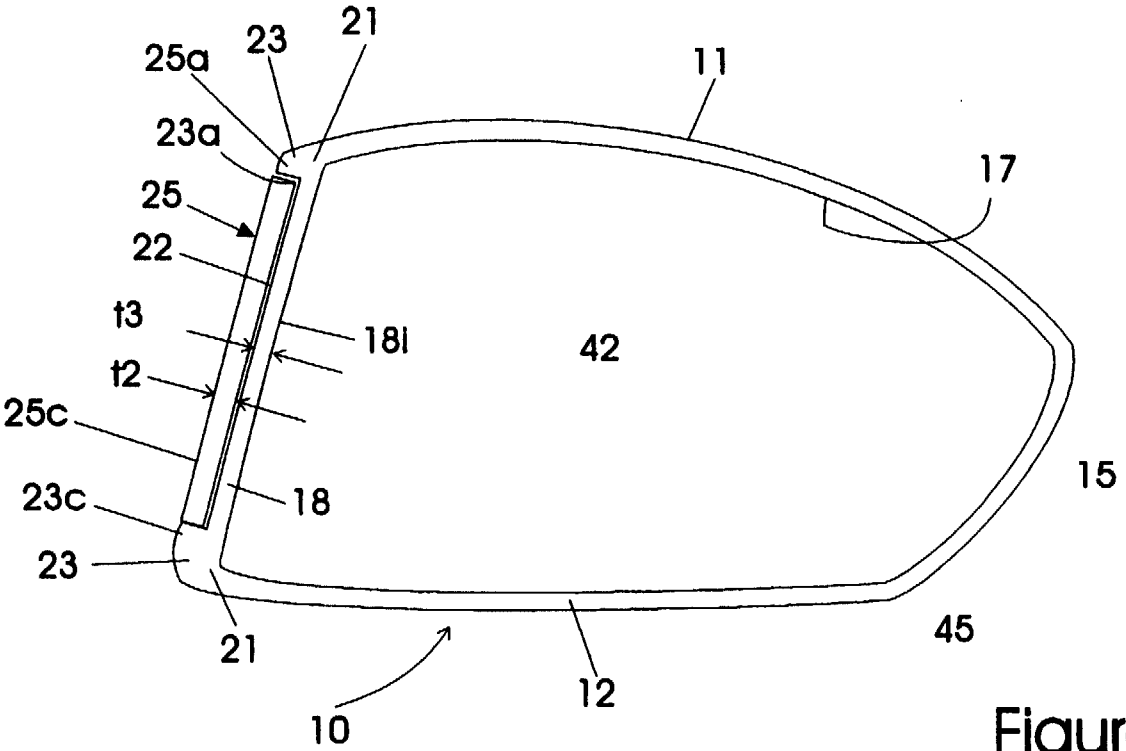
FIG. 2 is a section taken on lines 2—2 of FIG. 1.
Figure 3:
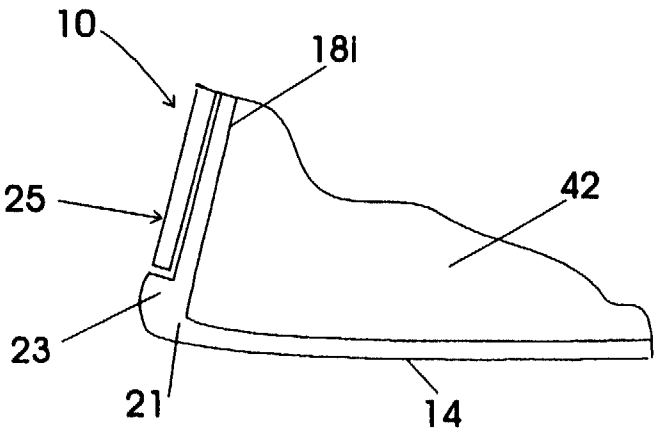
FIG. 3 is a fragmentary section taken on lines 3—3 of FIG. 1.
Figure 5:
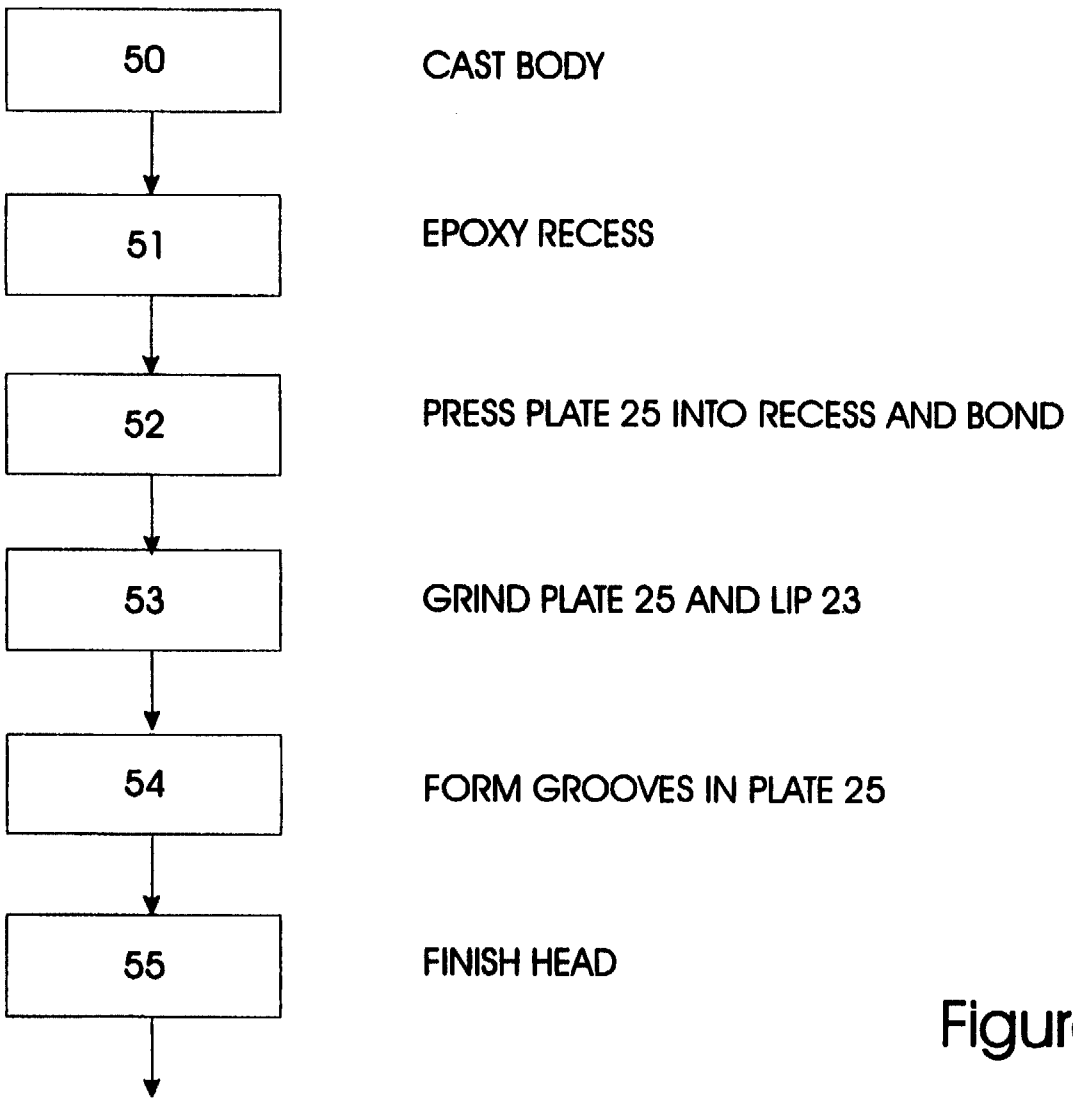
FIG. 5 is a block diagram showing certain steps carried out in forming the club head.

In FIGS. 1–3, a golf club head 10 includes a thin top wall 11, upwardly crowned; a thin flat bottom wall or sole 12; a thin toe wall 13; a thin heel wall 14; a thin rear wall 15; and a hosel 16 to which a golf club shaft 16A is suitably connected. Elements 11–15 define a main body portion formed, for example, by investment casting indicated at 50 in FIG. 5, using metallic material such as stainless steel, aluminum, beryllium copper, titanium, etc. The head has the configuration of a golf "wood" head, and forms a hollow or cavity 17.

The head also includes a front face reinforcement plate 18, which typically is formed of the same material as the main body portion of the head. It may be investment cast at the same time as the main body portion, and is integral with the latter. The principle extent of the plate 18 facing the cavity 17 is un-supported, i.e. only the plate looping periphery is joined to the main body portion, to support the plate. Immediately forward of the junction location 21, the plate is thickened to form a peripheral lip 23 that loops about, or bounds, a recess 22 extending parallel to and at the immediate front side of the plate 18.

As shown in FIGS. 1–3, a non-metallic ball striking second plate 25 is received or inset in the recess and retained therein. Plate 25 is affixed to reinforcement plate 18, and inner wall 23*a* of lip 23. Typically, the bounding edge or rim 25A of plate 25 firmly presses against wall 23A to form a tight fit therewith. To this end, the front plate 25 may be slightly oversized (peripherally) when pressed into position in the recess; also, the plate 25 may have oversized thickness $t_1$ (see FIG. 4) when pressed into the recess. This step is indicated at 52 in FIG. 5. See force arrows $F_1$ in FIG. 4. Epoxide resin may be employed at the interface 26 between plates 18 and 25, and also at the peripheral interface between 25*a* and 23*a*, to bond the plate 25 in position. See step 51 in FIG. 5.

Figure 4:
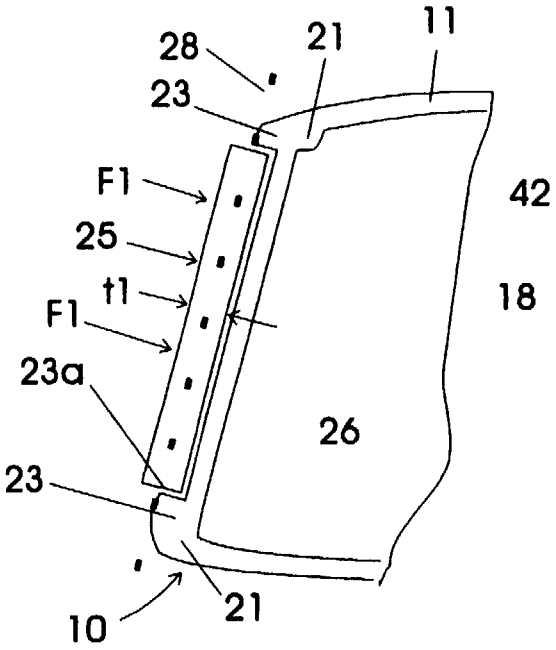
FIG. 4 is a sectional view like that of FIG. 2, but showing the method of assembling and shaping the non-metallic front plate as well as the lip of the metallic body.

After such intervention, the plate 25, and the bounding lip 23, are typically ground down to a level or plane indicated by broken line 28 in FIG. 4, to create a flush interface as seen at surfaces 25*c* and 23*c* in FIG. 2. See step 53 in FIG. 5.

Polished surface 23*c* bounds the plate 25, as in a modified trapezoidal loop, clearly indicated in FIG. 1. Thus, plate 25 has upper and lower outwardly shallowly convex edges 25*d* and 25*e*, and left and right outwardly shallowly convex edges 25*f* and 25*g*, with rounded corners at 25*h*–25*k*. Plate 18 has the same general peripheral configuration, to co-act with plate 25 but in a flexing rather than a compressive manner during ball striking, referred to below.

The plate 25 preferably consists of graphite, such as a composite of graphite fibers; however, other materials such as ceramic or KEVLAR may be employed.

Preferably, the final thickness of the plate 25 indicated at $t_2$ in FIG. 2, is about 2 mm; and the thickness $t_3$ of reinforcement plate 23 is also about 2 mm, over their bonded together extents. Thus, when striking a golf ball at high head speed, as during a golf swing, the plate 25 slightly resiliently compresses, and the plate 23 slightly flexes, plate 25 serving to spread the compressive force application over area of plate 23. The combination of local compressive deflection of plate 25 and flexing of plate 23 serves to control ball handling and distribute impact loading during contact of the ball with the head. The lightweight, non-metallic plate 25 also enables some reduction in thickness of heavier metal plate 23, without diminution of total strength of both plates. This is of particular importance in a hollow wood head configuration, where weight limitation exists. Thus, if weight is reduced by use of plates 23 and 25, instead of a single metal face plate of thickness $t_2$ and $t_3$, said weight saving can go to increased head size. Finally, shallow horizontal grooves 40 can be cut in the surface of non-metallic plate 25, to a depth less than $t_2$, and the head otherwise finished as by polishing, etc. These steps appear at 54 and 55 in FIG. 5. Synthetic resinous foam filler 42 appears in FIGS. 2 and 3, and serves along with plate 25 to deaden the sound created by head impact with a golf ball. Resin 42 engages the inner side 18*i* of metal plate 23, for this purpose. Confinement of metal plate 18 between two sound deadening non-metallic materials at 25 and 42, serves to dampen or deaden sound waves.

FIG. 2 indicates a plugged port 45, via which synthetic resin may be introduced, prior to plugging. Other known techniques of resin fill into a hollow cavity may be employed.

Figure 6:
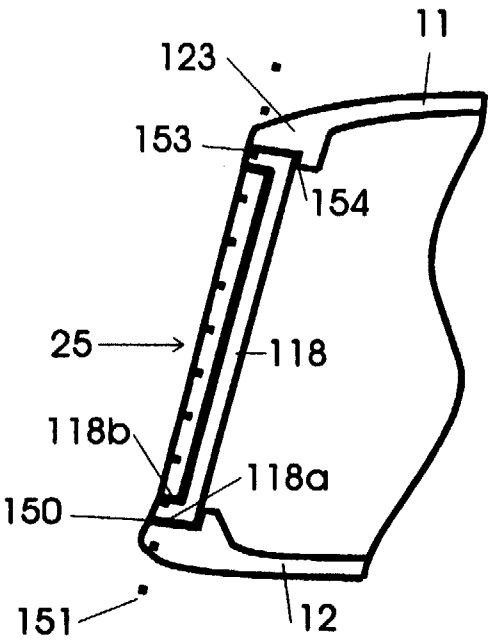
FIG. 6 is a view like FIG. 2, showing a modification.
Figure 7:
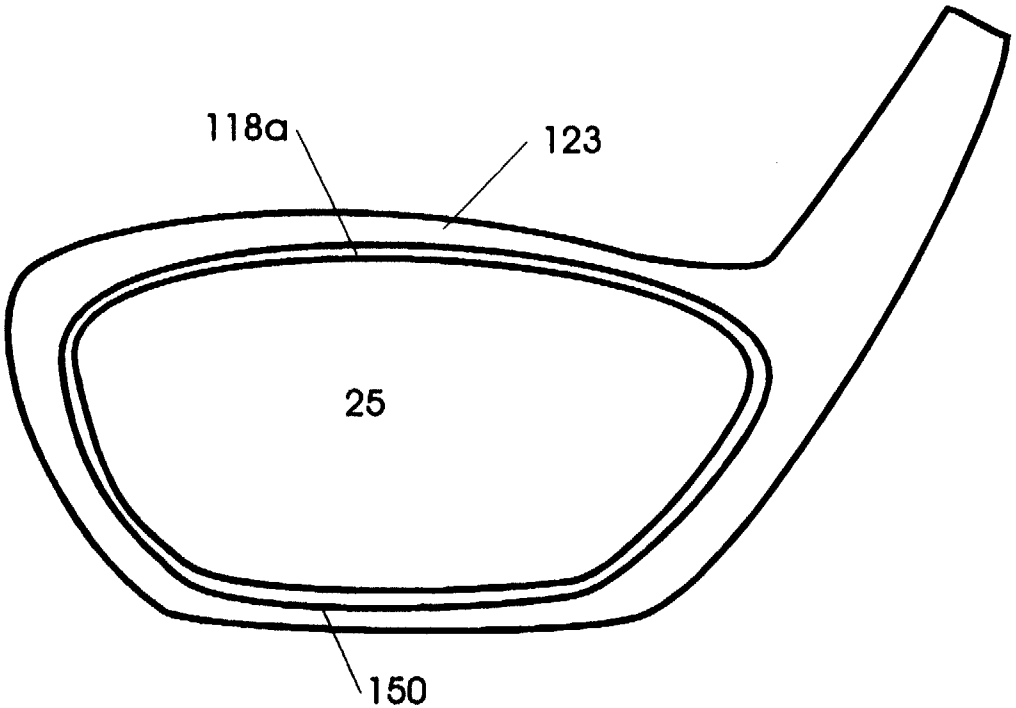
FIG. 7 is a frontal view of the FIG. 6 head.

In FIGS. 6 and 7, the construction of the golf club head is like that of FIG. 2, with certain exceptions. Reinforcement plate 118 (corresponding to plate 18) is here a forged metal plate which is welded to the head main body portion (casting) 11–15. Thus, the forged metal plate has a looping periphery 118*a* welded to the main body portion. See looping weld 150, which is generally trapezoidal and is intersected by a plane 151 defined by the second plate 25. The latter is the same as in FIGS. 1–5, and may be press-fitted into plate 118.

The head main body portion (casting) has a lip 123 (corresponding to lip 23) which defines a looping recess 153 that receives the looping periphery of the plate 118, the latter seated on a ledge or ledges 154 formed by the lip 123. Weld 150 also extends in the recess 153. Both the recess 153 and plate periphery 118*a* are generally trapezoidal about the second plate 25. The forged plate 118 and head main body portions 11–15, and 123 may both consist of the same metal, such as stainless steel. After assembly, the elements 123, 150, 118 and 25 may be surface ground, as described before, as in FIG. 4.

The use of a forged metal plate 118 provides enhanced strength for absorbing golf ball impact loading from plate 25 (and distributed by plate 25); and the thus enabled reduced thickness of the plate 118, together with the trapezoidal configuration of weld metal, enables increased head weight distribution toward the toe and heel, as is desired to resist head twist during such ball impact, while also benefitting from the advantage of non-metallic plate 25, as described.

We claim:

1. The method of forming a high strength, metallic, golf club head, which includes:

a) providing a golf club head main body consisting of metal, and a metallic face reinforcement plate peripherally connected to said main body which is hollow, b) said reinforcement plate forming a recess bounded by a lip, c) providing a non-metallic ball striking second plate, and affixing said second plate to said reinforcement plate, so as to be inset in said recess and bounded by said lip, said step of providing a non-metallic ball striking second plate includes connecting the periphery of the second face plate to said lip; and including grinding said lip and said second plate to form a forwardly facing smooth head surface wherein the forward face of the non-metallic second plate is flush with the forward facing surface of the metallic lip.

2. The method of claim 1 wherein said reinforcement plate has a thickness of about 2 mm, and said grinding is carried out to reduce the thickness of the second plate to about 2 mm.

3. A golf club head comprising:

a) a main body portion formed by casting of a first metallic material, and forming a cavity, b) a front face reinforcement plate formed of metallic material, only the periphery of said face reinforcement plate being integral with said main body portion to support said plate, said plate forming a recess bounded by a peripheral lip, c) and a non-metallic ball striking second plate received in said recess and retained therein, said front face reinforcement plate is a forged metal plate which is welded to said head main body portion in abutting relation to said second plate.

4. The golf club head of claim 3 wherein said forged metal plate has a looping periphery which is welded to said head main body portion.

5. The golf club head of claim 4 wherein said ball striking second plate defines a plane that intersects said welded looping periphery.

6. The golf club head of claim 4 wherein said head main body portion defines a looping recess receiving said looping periphery of said forged metal plate.

7. The golf club head of claim 6 wherein said looping periphery of the forged metal plate is generally trapezoidal about the non-metallic second plate.

8. The golf club head of claim 3 wherein the head main body portion and the forged metal plate both consist of substantially the same metal.

9. The golf club head of claim 8 wherein the second plate consists of graphite.

10. The method of forming a high strength golf club head that includes a) forming a thin cast metallic golf club head body having a front opening, the body forming toe, heel and rearward portion of the head, b) forming a forged metal plate of a size to close said front opening, and having a frontwardly facing recess, c) peripherally welding the forged plate to the cast body to close said front opening and to peripherally support the plate, d) and providing a graphite plate of a size to fill said recess, and fitting said graphite plate into said recess and attaching the graphite plate to the forged plate.

* * * * *